United States Patent [19]

Ogura et al.

[11] Patent Number: 4,757,342

[45] Date of Patent: Jul. 12, 1988

[54] PHOTORECEPTOR CARTRIDGE UNIT

[75] Inventors: Mitsuru Ogura, Nara; Keizo Fukunaga; Takeshi Yoshida, both of Yamatokoriyama, all of Japan

[73] Assignee: Sharp Kabushiki Kaisha, Osaka, Japan

[21] Appl. No.: 945,653

[22] Filed: Dec. 23, 1986

[30] Foreign Application Priority Data

Dec. 27, 1985 [JP] Japan ..... 60-297302
Dec. 27, 1985 [JP] Japan ..... 60-202922[U]

[51] Int. Cl.[4] ..... G03G 15/00

[52] U.S. Cl. ..... 355/3 DR; 355/3 R; 355/3 DD

[58] Field of Search ..... 355/3 DD, 3 DR, 3 R, 355/3 CH

[56] References Cited

U.S. PATENT DOCUMENTS 4,470,689 9/1984 Nomura et al. ..... 355/3 R
4,540,268 9/1985 Toyono et al. ..... 355/3 R
4,556,308 12/1985 Hoppner et al. ..... 355/3 R
4,563,074 1/1986 Tsutsui et al. ..... 355/3 DD
4,566,780 1/1986 Kajita et al. ..... 355/3 DR X
4,627,701 12/1986 Onoda et al. ..... 355/3 CH

FOREIGN PATENT DOCUMENTS 2074095 10/1981 United Kingdom ..... 355/3 DR

*Primary Examiner*—Patrick R. Salce
*Assistant Examiner*—Kristine Peckman
*Attorney, Agent, or Firm*—Birch, Stewart, Kolasch & Birch

[57] ABSTRACT

A photoreceptor cartridge unit having a cartridge frame made of plastic on which a photoreceptor drum acting as a rotary member and its peripheral components are integrally mounted. The cartridge frame is formed with a plurality of bearing portions for supporting the rotary members and a plurality of positioning projections and is split, at the bearing portions, into two frame portions provided with an engageable portion and a receiver portion, respectively. The peripheral components are formed with a plurality of positioning holes so as to be mounted on the cartridge frame through engagement of the positioning projections with the positioning holes. The two frame portions are coupled with each other through engagement of the engageable portion with the receiver portion.

5 Claims, 8 Drawing Sheets

PHOTORECEPTOR CARTRIDGE UNIT

BACKGROUND OF THE INVENTION

The present invention generally relates to a photoreceptor (photosensitive) drum and more particularly, to a photoreceptor cartridge unit in which the photoreceptor drum and its peripheral components are integrally accommodated.

In response to recent trends toward compactness for an image forming apparatus such as a copying apparatus, a cartridge unit in which a photoreceptor drum and its peripheral components are integrally accommodated is put to practical use from a maintenance-free viewpoint so that replacement of the components, such as the photoreceptor drum, can be performed by users without the need for calling servicemen. If the photoreceptor drum and one of the components to be replaced after a predetermined time period of operation, for example, a cleaning unit including a container for storing waste toner, are integrally accommodated in the cartridge unit, users can advantageously continue to use the copying apparatus by replacing for themselves the cartridge unit with a new unit without calling a serviceman when need of replacement of the component arises.

However, known cartridge units have such a drawback that since bearing portions of rotary members, such as the photoreceptor drum, are preliminarily attached to a cartridge frame in order to mount the rotary members on the cartridge frame and machine screws or nuts are used for mounting the peripheral components such as the above described cleaner unit on the cartridge frame, the working efficiency will be quite low and the cartridge unit becomes complicated in structure.

Furthermore, in the case where the photoreceptor drum and a corona charger constituted by a discharge wire and a casing are integrally accommodated in the known cartridge unit, machine screws for attaching the corona charger to the cartridge frame are required to be spaced away from the support portions for supporting the discharge wire such that electrical discharge leading from the support portions to the machine screws is prevented, thereby resulting in the difficulty of making the cartridge unit compact in size.

SUMMARY OF THE INVENTION

Accordingly, an essential object of the present invention is to provide a photoreceptor cartridge unit in which a photoreceptor drum and its peripheral components can be easily mounted on a cartridge frame split into upper and lower frame portions and the upper and lower frame portions can be simply coupled with each other, with substantial elimination of the disadvantages inherent in conventional cartridge units of this kind.

Another important object of the present invention is to provide a photoreceptor cartridge unit of the above described type in which one of the peripheral components, a corona charger, can be mounted on the cartridge frame easily without the need for using metallic parts such as machine screws.

In order to accomplish these objects of the present invention, there is provided a photoreceptor cartridge unit for use in an image forming apparatus having an apparatus housing, the photoreceptor cartridge unit being detachably mounted on the apparatus housing and having a cartridge frame on which a photoreceptor drum and its peripheral components are integrally mounted such that at least the photoreceptor drum is rotatably supported, as a rotary member, by the cartridge frame, the improvement being that the cartridge frame is made of plastic and formed with a plurality of bearing portions for supporting the rotary member. The cartridge frame is split at the bearing portions into two frame portions and a pair of integrally formed elastic pieces is provided at each of at least a part of the bearing portions, with the cartridge frame, so as to confront each other. A plurality of holes for positioning the peripheral components are formed thereon, and a plurality of projections for positioning the peripheral components, are formed on the cartridge frame so as to be fitted into the holes, respectively. The peripheral components are mounted on the cartridge frame by fusion bonding the projections to the peripheral components after the projections have been fitted into the holes, respectively. An engageable portion is formed at an end portion of one of the two frame portions and a receiver portion for receiving the engageable portion is formed at an end portion of the other one of the two frame portions such that the two frame portions are coupled with each other through engagement of the engageable portion with the receiver portion.

In the photoreceptor cartridge unit of the present invention, the cartridge frame is made of plastic and the bearing portions for supporting the rotary members are directly formed on the cartridge frame by molding. Thus, in accordance with the present invention, the rotary members, such as the photoreceptor drum, can be easily mounted on the cartridge frame and the photoreceptor cartridge unit is thus simplified in construction.

Meanwhile, in accordance with the present invention, since the projections for positioning the peripheral components are formed on the cartridge frame so as to be fitted into the holes formed on the peripheral components such that the projections are fusion bonded to the peripheral components when the projections have been fitted into the respective holes, the peripheral components can be easily mounted on the cartridge frame.

Furthermore, in accordance with the present invention, since the cartridge frame is divided into the two frame portions formed with the engageable portion and the receiver portion for receiving the engageable portion, respectively, the two frame portions can be simply coupled with each other through engagement of the engageable portion with the receiver portion.

BRIEF DESCRIPTION OF THE DRAWINGS

These objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
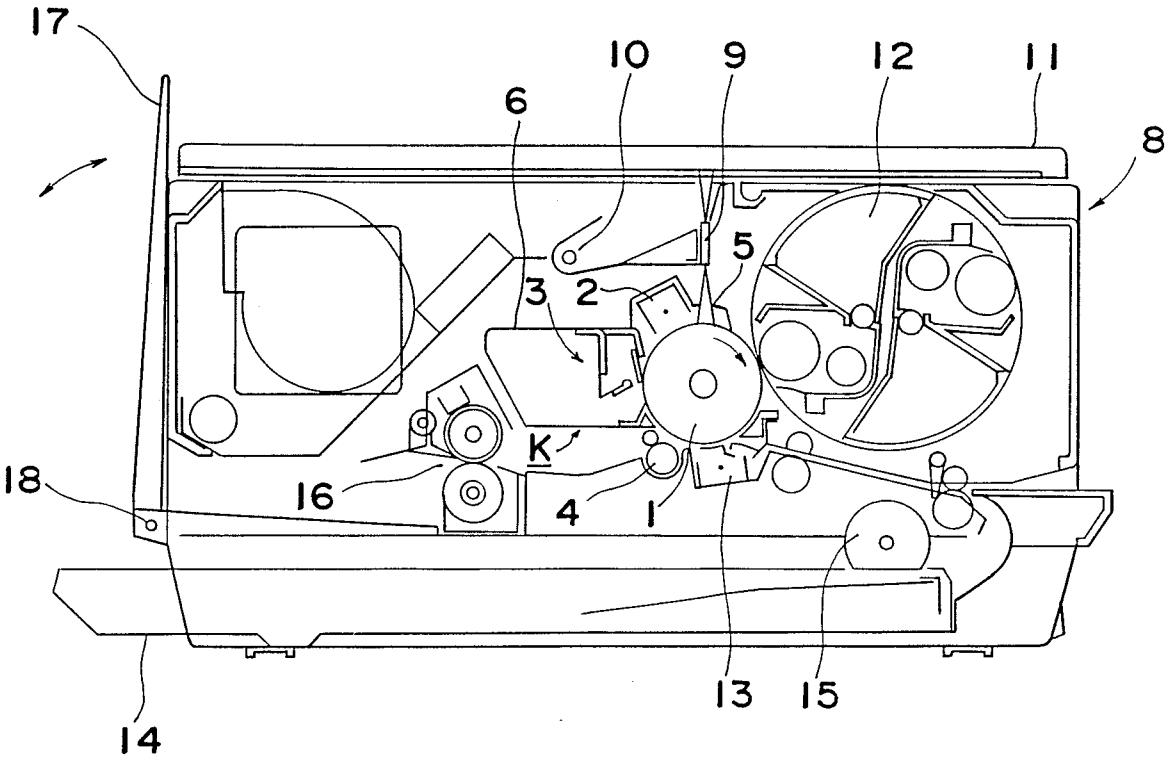
FIG. 1 is a schematic sectional view of a copying apparatus, to which a photoreceptor cartridge unit according to one preferred embodiment of the present invention may be applied.

Referring now to the drawings, there is shown in FIG. 1, a copying apparatus to which a photoreceptor cartridge unit K according to one preferred embodiment of the present invention may be applied. The cartridge unit K includes a cartridge frame 6 formed with an exposure slit 5, in which a photoreceptor drum 1 and its peripheral components disposed around the photoreceptor drum 1, i.e. a corona charger 2, and a cleaning unit 3 are integrally mounted. The cartridge unit K is detachably mounted on an apparatus housing 8 of the copying apparatus. When the cartridge unit K is depressed into the apparatus housing 8 in the direction perpendicular to and towards the sheet surface of FIG. 1, after opening a front panel of the apparatus housing 8, the cartridge unit K is mounted on the apparatus housing 8. On the contrary, when the cartridge unit K is pulled out of the apparatus housing 8 in the direction perpendicular to and away from the sheet surface of FIG. 1, the cartridge unit K is detached from the apparatus housing 8. The cartridge unit K is mounted on or detached from the apparatus housing 8 by a guide mechanism (not shown) including a pair of rails.

A known image transmitter 9 formed of a plurality of graded index fibers in bundled configuration is disposed above the exposure slit 5. An optical system is constituted by the image transmitter 9 and a light source 10 disposed at the left side of the image transmitter 9. An image of an original document placed on an original platform 11 is scanned by light from the light source 10 upon horizontal travel of the original platform 11 in FIG. 1 and is exposed, through the image transmitter 9, onto the photoreceptor drum 1 to form a latent image. After the photoreceptor drum 1 rotating in the direction of the arrow of FIG. 1 has been uniformly electrically charged by the corona charger 2, the photoreceptor drum 1 is exposed by light having passed through the exposure slit 5. Then, the latent image on the photoreceptor drum 1 is developed into a visible toner image by a developing device 12. Subsequently, the visible toner image on the photoreceptor drum 1 is transferred onto a copy paper sheet by a transfer charger 13. The copy paper sheets are stacked in a cassette 14 inserted into a bottom portion of the apparatus housing 8 and are fed towards the photoreceptor drum 1 sheet by sheet by a paper feeding roller 15. The copy paper sheet having the visible toner image transferred from the photoreceptor drum 1 is separated from the photoreceptor drum 1 by the separator unit 4 and is transported to a pair of fixing rollers 16 such that the toner image on the copy paper sheet is fixed by the fixing rollers 16. Thereafter, the copy paper sheet having the toner image fixed thereon is ejected onto a copy receiving tray 17.

Meanwhile, the copy receiving tray 17 is arranged to be rotated about a pin 18 in the directions of the arrows of FIG. 1. When a copying operation is performed, the copy receiving tray 17 is rotated about the pin 18 in the counterclockwise direction in FIG. 1 from the position shown in FIG. 1 so as to be fixed at a position substantially parallel to the face of the original platform 11. The developing device 12 has two developing portions such that either one of the developing portions can be used through rotation of the developing device 12.

Figure 2:
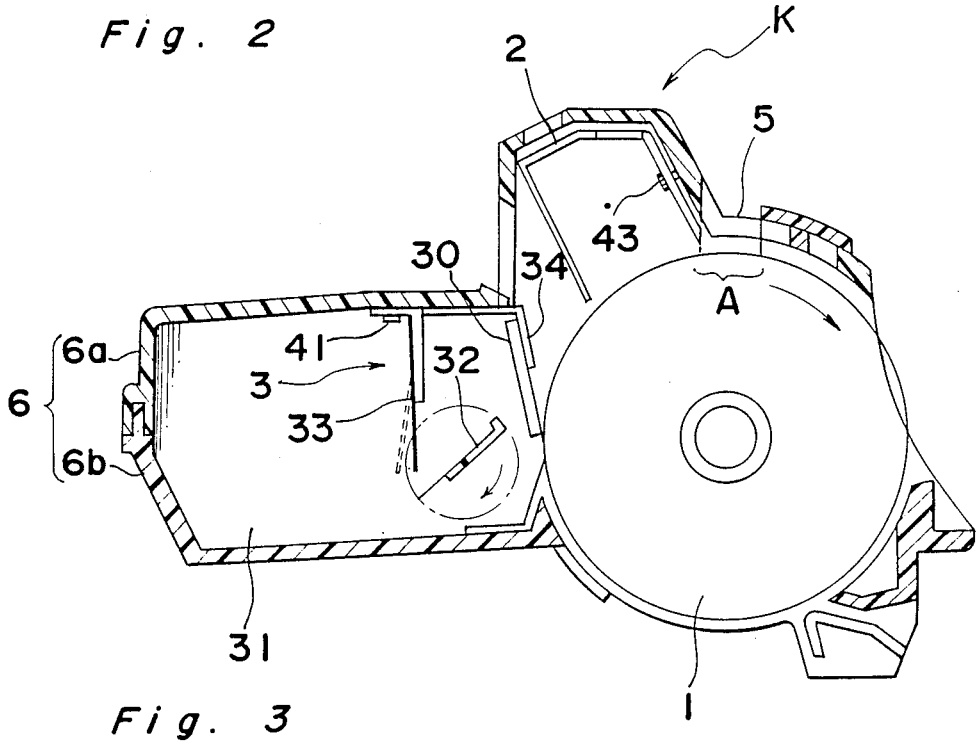
FIG. 2 is a sectional view of the photoreceptor cartridge unit of FIG. 1.

FIG. 2 shows the cartridge unit K. The cartridge frame 6 is constituted by an upper frame portion 6*a* and a lower frame portion 6*b*. A rotary shaft of the photoreceptor drum 1, the corona charger 2, and the cleaning unit 3 are attached to the cartridge frame 6. The upper frame portion 6*a* is formed, at its portion confronting an exposure portion A of the photoreceptor drum 1, with the exposure slit 5. The cleaning unit 3 is constituted by a blade 30 for scraping residual toner off the peripheral surface of the photoreceptor drum 1, a container 31 for storing the residual toner, a rotary plate 32 for feeding the residual toner to the container 31 and a partition plate 33 for partitioning the container 31. As shown in FIG. 2, the corona charger 2 and a mounting plate 34, having the blade 30 and the partition plate 33 mounted thereon, are mounted on the upper frame portion 6*a* by fusion bonding a positioning projection 43 and a positioning projection 41 to the corona charger 2 and the mounting plate 34, respectively.

Figure 3:
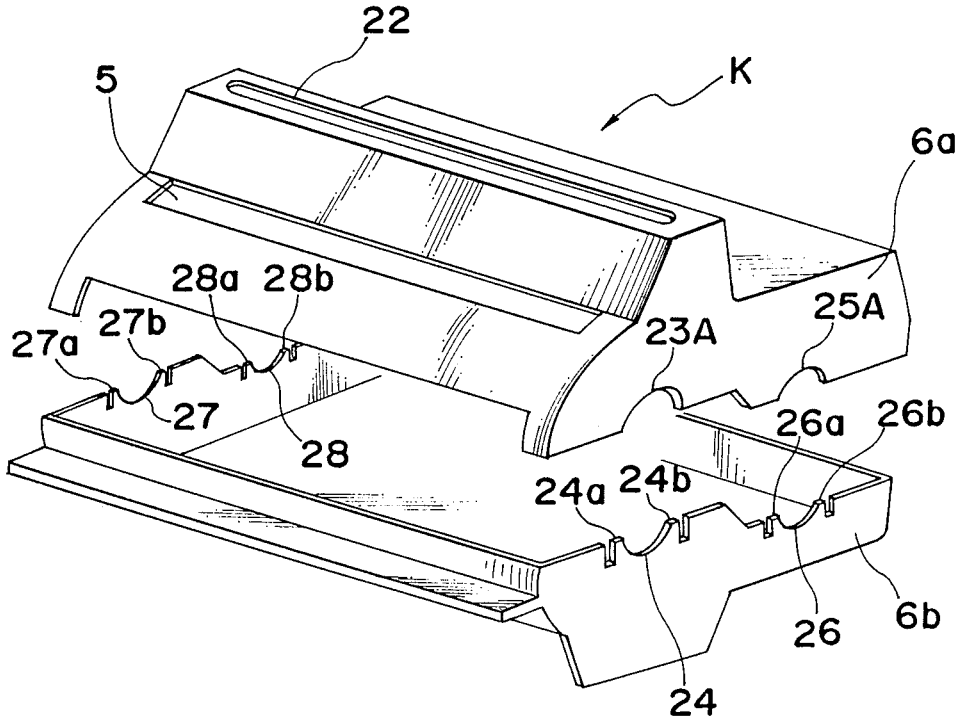
FIG. 3 is a perspective view of upper and lower frame portions of a cartridge frame of the photoreceptor cartridge unit of FIG 2.

FIG. 3 shows the upper frame portion 6*a* and the lower frame portion 6*b*. As shown, the upper frame portion 6*a* is formed, at its opposite end walls, with coaxial half bearing portions 23A and 23B (FIG. 4) for supporting the photoreceptor drum 1 and coaxial half bearing portions 25A and 25B (FIG. 4) for supporting the rotary plate 32 such that the half bearing portions 23A and 23B are sidewise juxtaposed with respect to the half bearing portions 25A and 25B. Likewise, the lower frame portion 6*b* is formed, at its opposite end walls, with coaxial half bearing portions 24 and 27 for supporting the photoreceptor drum 1 and coaxial half bearing portions 26 and 28 for supporting the rotary plate 32 such that the half bearing portions 24 and 27 are sidewise juxtaposed with respect to the half bearing portions 26 and 28. Namely, the cartridge frame 6 is horizontally divided, at the half bearing portions 23A, 23B, 25A, 25B, 24, 27, 26 and 28, into the upper frame portion 6*a* and the lower frame portion 6*b*. The upper frame portion 6*a* and the lower frame portion 6*b* are made of plastic. The half bearing portions 23A, 23B, 25A and 25B are integrally formed with the upper frame portion 6*a* by molding. Similarly, the half bearing portions 24, 27, 26 and 28 are integrally formed with the lower frame portion 6*b* by molding. A pair of sidewise opposed elastic pieces 24*a* and 24*b*, a pair of sidewise opposed elastic pieces 26*a* and 26*b*, a pair of sidewise opposed elastic pieces 27*a* and 27*b* and a pair of sidewise opposed elastic pieces 28*a* and 28*b* are respectively provided at the half bearing portions 24, 26, 27 and 28. The upper frame 6*a* is formed with an opening 22 for discharging therethrough ozone produced by the corona charger 2. Meanwhile, the elastic pieces are provided only at the lower frame portion 6*b* in this embodiment but can be provided also at the upper frame portion 6*a*.

Figure 4:
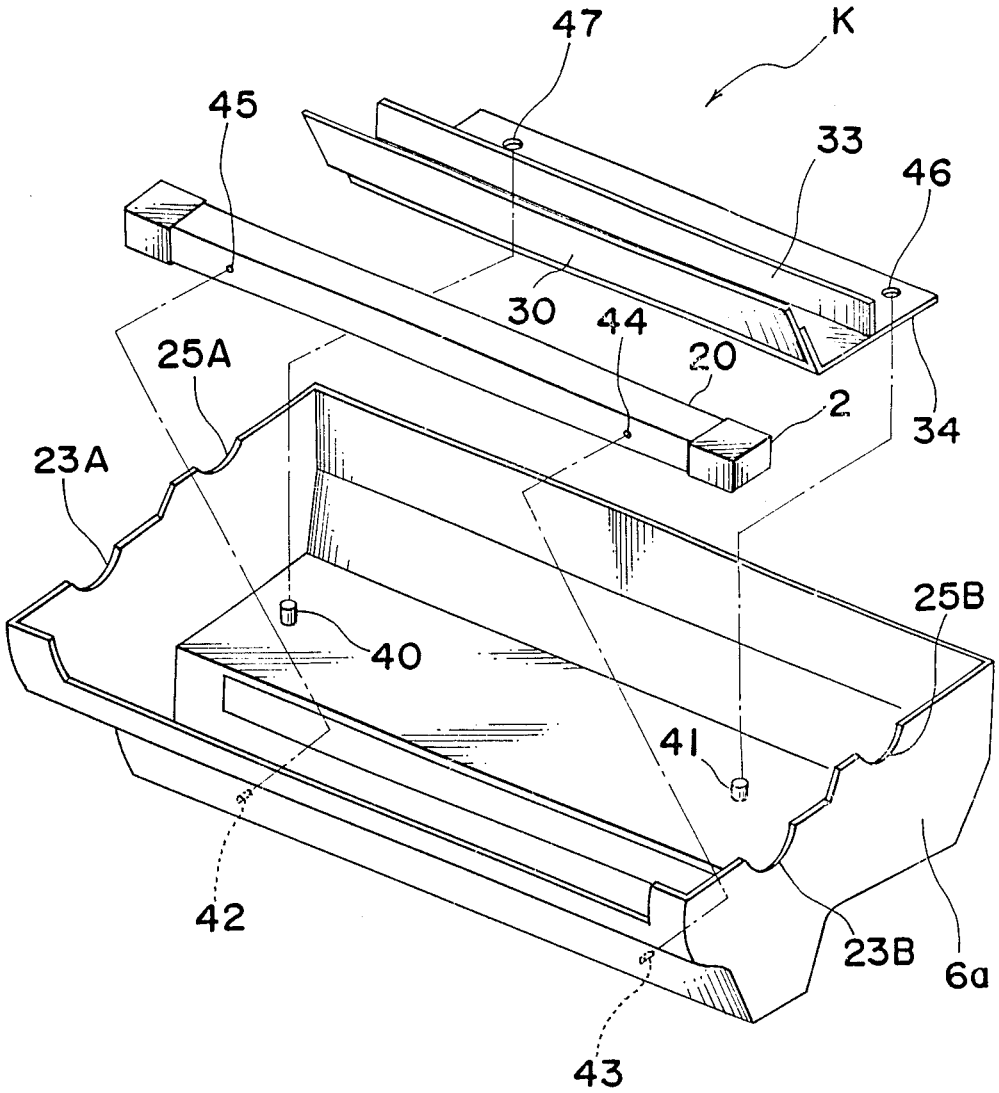
FIG. 4 is a view indicative of mounting of peripheral components of a photoreceptor drum on the upper frame portion.

FIG. 4 shows an arrangement in which the corona charger 2 and the mounting plate 34, having the blade 30 and the partition plate 33 attached thereto, are mounted on the upper frame portion 6*a* from one direction. To this end, positioning projections 40 to 43 are integrally formed with the upper frame portion 6*a*, as shown, at the time of molding of the upper frame portion 6*a*. Furthermore, positioning holes 44 and 45 are formed on a casing 20 of the corona charger 2 so as to receive the positioning projections 43 and 42, respectively. Meanwhile, positioning holes 46 and 47 are formed on the mounting plate 34 so as to receive the positioning projections 41 and 40, respectively. The corona charger 2 is mounted on the upper frame 6*a* by fusion bonding the positioning projections 42 and 43 from above to the casing 20 in a state where the positioning projections 42 and 43 have been fitted into the positioning holes 45 and 44, respectively. Likewise, the mounting plate 34 is mounted on the upper frame portion 6*a* by fusion bonding the positioning projections 40 and 41 from above to the mounting plate 34 in a state where the positioning projections 40 and 41 have been fitted into the positioning holes 47 and 46, respectively.

Figure 5:
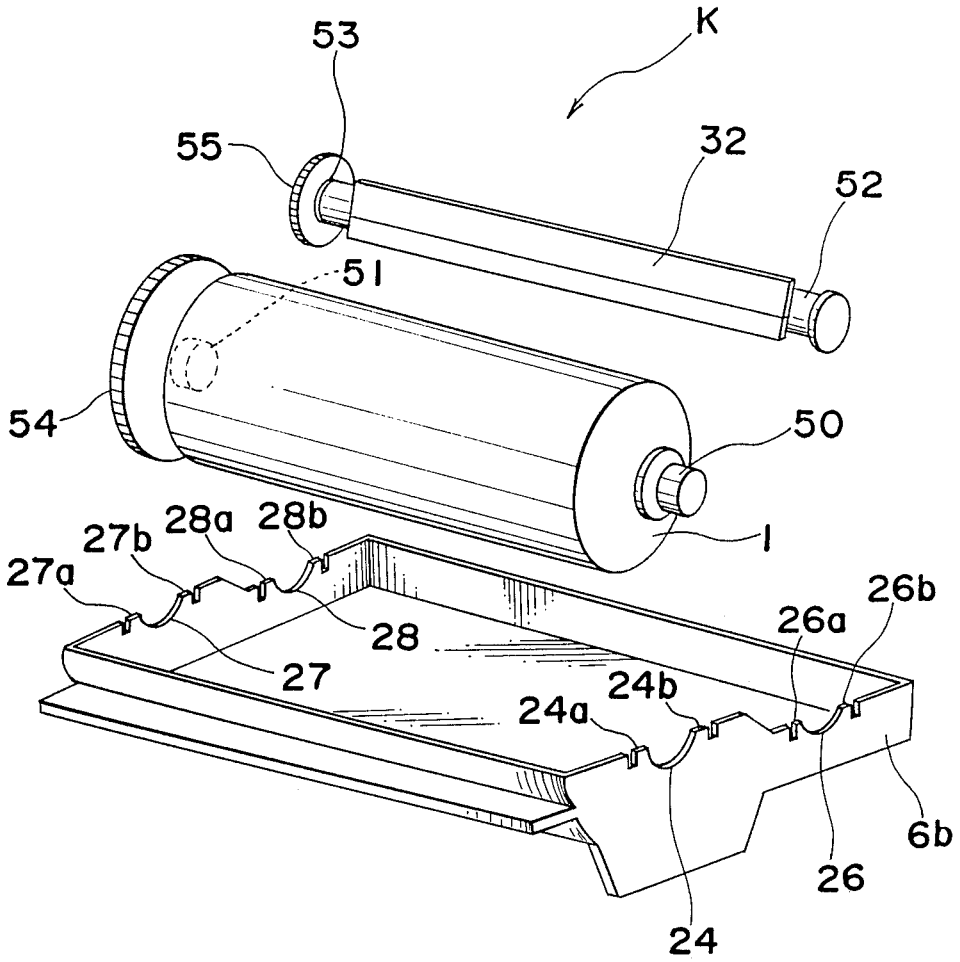
FIG. 5 is a view indicative of mounting of the photoreceptor drum and the peripheral components on the lower frame portion.

FIG. 5 shows an arrangement in which the photoreceptor drum 1 and the rotary plate 32 of the cleaning unit 3 are mounted on the lower frame portion 6*b* from one direction. The photoreceptor drum 1 having a pair of opposite shaft portions 50 and 51 is mounted on the lower frame portion 6*b* by fitting the shaft portions 50 and 51 into the half bearing portions 24 and 27, respectively. Similarly, the rotary plate 32 having a pair of opposite shaft portions 52 and 53 is mounted on the lower frame portion 6*b* by fitting the shaft portions 52 and 53 into the half bearing portions 26 and 28, respectively. As described above, the opposed elastic pieces 24*a* and 24*b*, the opposed elastic pieces 26*a* and 26*b*, the opposed elastic pieces 27*a* and 27*b* and the opposed elastic pieces 28*a* and 28*b* are, respectively, provided at the half bearing portions 24, 26, 27 and 28. Thus, the shaft portions 50 and 51 of the photoreceptor drum 1 are, respectively, fitted into the half bearing portions 24 and 27 smoothly, while the shaft portions 52 and 53 of the rotary plate 32 are, respectively, fitted into the half bearing portions 26 and 28 smoothly.

Figure 6:
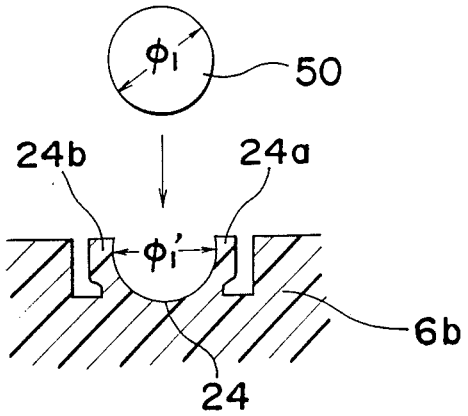
FIG. 6 is a fragmentary sectional view explanatory of mounting of the photoreceptor drum on the lower frame portion.

FIG. 6 shows an arrangement in which the shaft portion 50 of the photoreceptor drum 1 is mounted on the half bearing portion 24 of the lower frame portion 6*b*. A diameter $\phi 1'$ of the half bearing portion 24 is so set as to be substantially equal to a diameter $\phi 1$ of the shaft portion 50. The opposed elastic pieces 24*a* and 24*b* are shaped such that an arc portion of the half bearing portion 24 is slightly larger than a semicircle defined by the half bearing portion 24. By this arrangement, when the shaft portion 50 is lowered from above into the half bearing portion 24, the elastic pieces 24*a* and 24*b* are initially depressed radially outwardly by the shaft portion 50. Subsequently, when the shaft portion 50 has been deeply fitted into the half bearing portion 24, the elastic pieces 24*a* and 24*b* are again returned to their initial states and thus, the shaft portion 50 is fitted into the half bearing portion 24. Since fitting of other shaft portions 51 to 53 is performed in the same manner as described above, description thereof is not repeated for the sake of brevity.

Figure 7A:
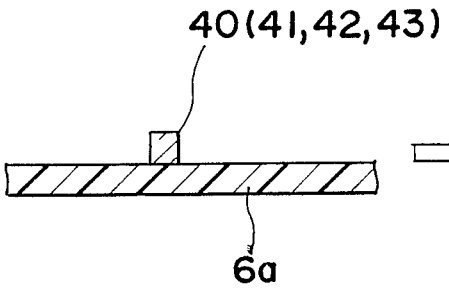
FIGS. 7A to 7C are fragmentary sectional views explanatory of mounting of the peripheral components on the upper frame portion.
Figure 7B:
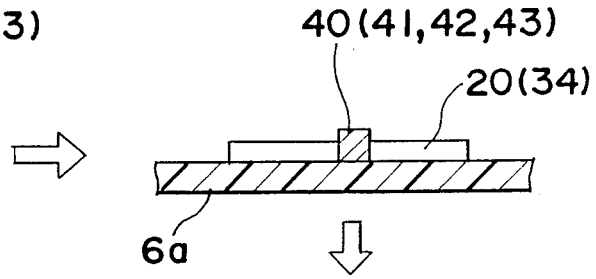
Figure 7C:
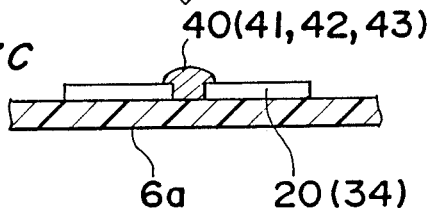

FIGS. 7A to 7C show stepwise an arrangement in which the corona charger 2 and the mounting plate 34 are mounted on the upper frame portion 6*a* as described with reference to FIG. 4. As shown, the positioning projections 40, 41, 42 and 43 are fitted through the positioning holes 47 and 46 of the mounting plate 34 and the positioning holes 45 and 44 of the casing 20 of the corona charger 2, respectively such that distal end portions of the positioning projections 40 and 41 are fusion bonded to the mounting plate 34, with distal end portions of the positioning projections 42 and 43 being fusion bonded to the casing 20.

Figure 8:
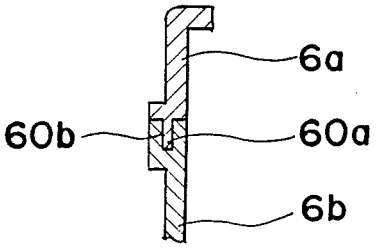
FIG. 8 is a fragmentary sectional view explanatory of coupling of the upper and lower frame portions.

As described above, the corona charger 2 and the mounting plate 34, having the blade 30 and the partition plate 33 mounted thereon, are secured to the upper frame portion 6*a* by fusion bonding. Then, after the photoreceptor drum 1 and the rotary plate 32 of the cleaner unit 3 have been mounted on the lower frame portion 6*b*, the upper frame portion 6*a* and the lower frame portion 6*b* are coupled with each other. FIG. 8 shows an arrangement in which the upper frame portion 6*a* and the lower frame portion 6*b* are coupled with each other. The upper frame portion 6*a* is formed, at an end portion thereof, with a protrusion 60*a* acting as an engageable portion, while the lower frame portion 6*b* is formed, at an end portion thereof, with a recess 60*b* acting as a receiver portion for receiving the engageable portion such that the protrusion 60*a* and the recess 60*b* are brought into engagement with each other. The upper frame portion 6*a* and the lower frame portion 6*b* are coupled with each other through engagement of the protrusion 60*a* with the recess 60*b*. Meanwhile, when a thickness of the protrusion 60*a* is set so as to be slightly larger than a width of the recess 60*b*, the upper frame portion 6*a* and the lower frame portion 6*b* can be coupled with each other more positively through tight fit between the protrusion 60*a* and the recess 60*b*. In order to couple the upper frame portion 6*a* and the lower frame portion 6*b* with each other more completely, it can also be so arranged that the protrusion 60*a* is fusion bonded to the recess 60*b* by ultrasonic sound after the upper frame portion 6*a* and the lower frame portion 6*b* have been coupled with each other.

Thus, in this embodiment, after the corona charger 2 and the mounting plate 34, having the blade 30 and the partition plate 33 mounted thereon, have been initially mounted on the upper frame portion 6*a* from one direction so as to be secured to the upper frame portion 6*a* by fusion bonding, the shafts of the photoreceptor drum 1 and the rotary plate 32 of the cleaning unit 3 are fitted into the bearing portions of the lower frame portion 6*b* from one direction. Subsequently, the upper frame portion 6*a* and the lower frame portion 6*b* are coupled with each other through engagement between the engageable portion provided at the end portion of the upper frame portion 6*a* and the receiver portion provided at the end portion of lower frame portion 6*b*, whereby assembly of the cartridge unit K is completed.

As is clear from the foregoing description, in accordance with the present invention, each of the shaft portions of the rotary members, such as the photoreceptor, are inserted into each of the bearing portions formed at one of the split upper and lower frame portions of the cartridge frame so as to be gripped between the two elastic pieces provided at each of the bearing portions and each of the peripheral components formed with the positioning holes can be mounted on the cartridge frame formed with the positioning projections by merely fusion bonding the positioning projections to each of the peripheral components after the positioning projections have been fitted into the positioning holes, respectively. Meanwhile, the split upper and lower frame portions of the cartridge frame can be easily coupled with each other through engagement of their end portions after the necessary peripheral components and rotary members have been mounted on the cartridge frame.

Namely, in accordance with the present invention, the peripheral components and the rotary members, such as the photoreceptor, can be easily mounted on the split upper and lower frame portions of the cartridge frame by their fitting and fusion bonding without the need for using machine screws, screws, etc. for assembling the cartridge unit.

Furthermore, in accordance with the present invention, since the cartridge frame is divided at the bearing portions for supporting the rotary members, into the upper and lower frame portions, the peripheral components can be mounted on the cartridge frame from one direction and thus, the cartridge frame can be assembled quite simply, thereby resulting in remarkably high productivity.

Moreover, in accordance with the present invention, the cartridge unit is simplified in construction thus resulting in reduction of its production cost.

Figure 9:
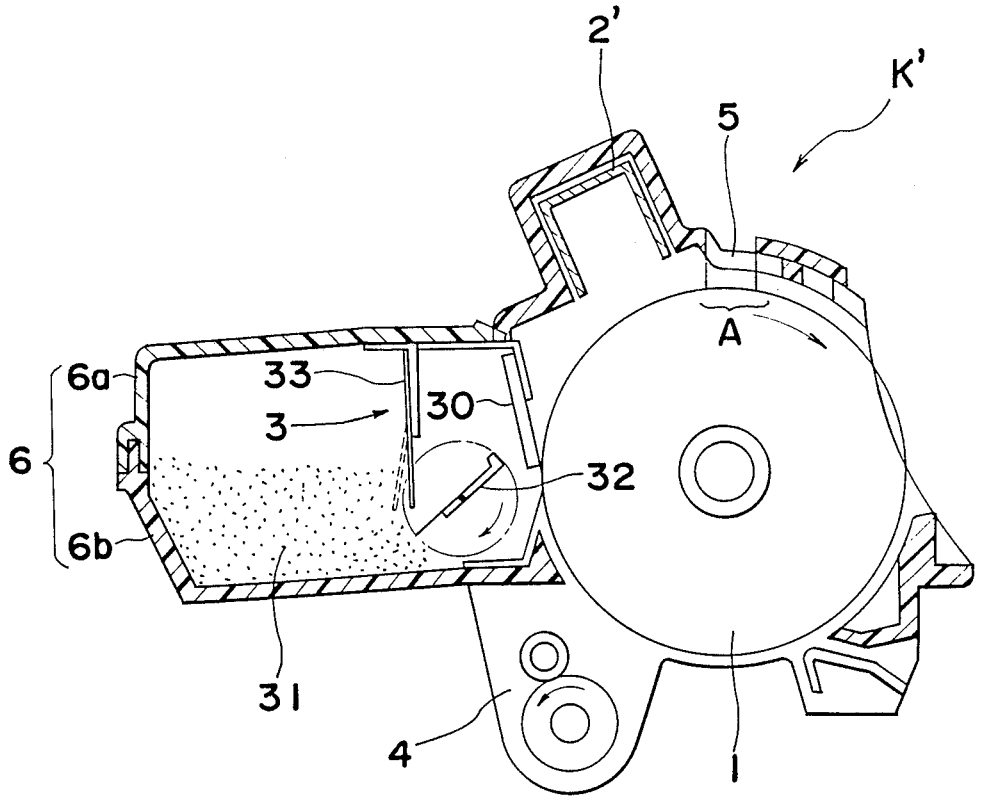
FIG. 9 is a view similar to FIG. 2, particularly showing a modification thereof.

Referring to FIGS. 9 to 12, there is shown a photoreceptor cartridge unit K' which is a modification of the photoreceptor cartridge unit K. In the cartridge unit K', the corona charger 2 of the cartridge unit K is replaced by a corona charger 2'. As shown in FIG. 9, the photoreceptor drum 1, the corona charger 2', the cleaning unit 3 and the separator unit 4 are mounted on the cartridge frame 6 as in the cartridge unit K.

Figure 10:
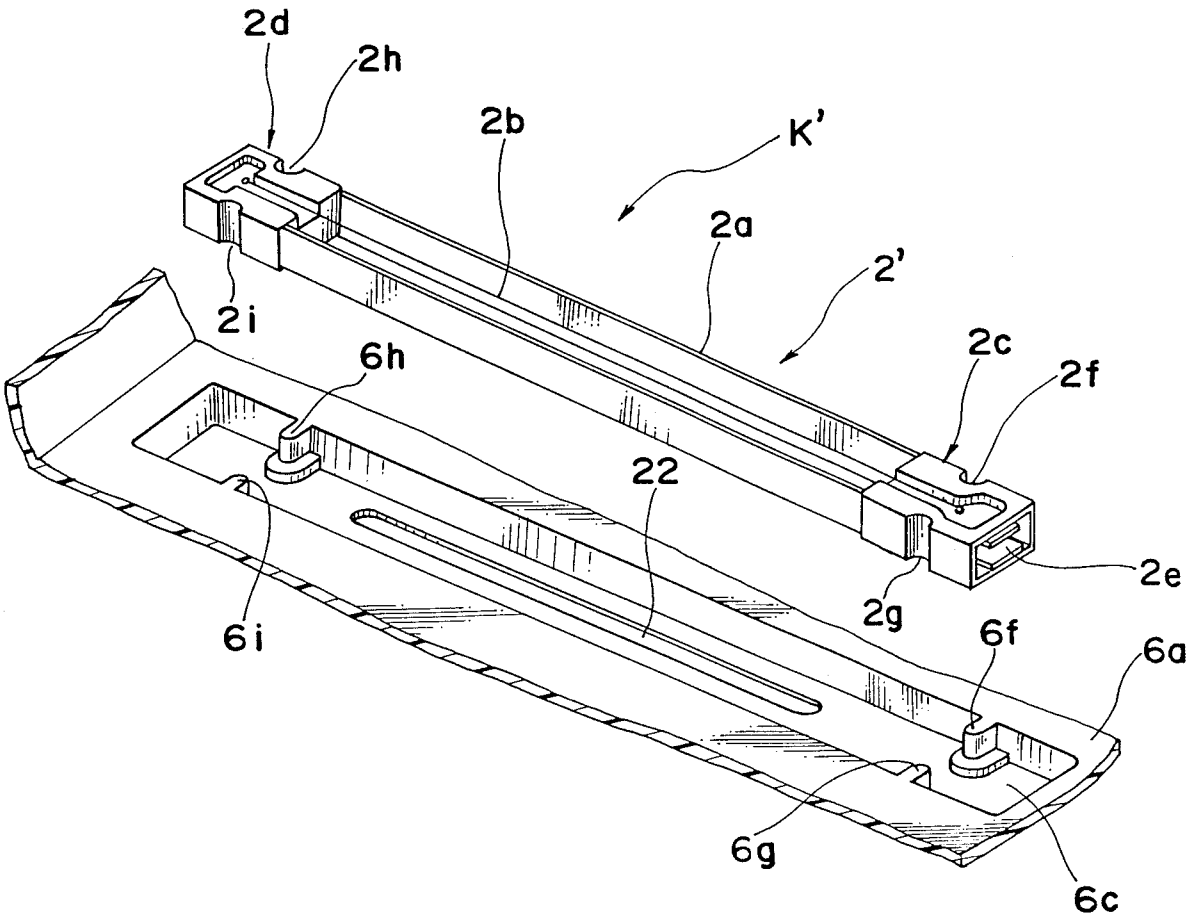
FIG. 10 is a perspective view of one of the peripheral components, a corona charger and the upper frame portion employed in the photoreceptor cartridge unit of FIG. 9.

FIG. 10 shows constructions of the corona charger 2' and the upper frame portion 6a. The corona charger 2' is constituted by a metallic casing 2a having a substantially U-shaped cross section, a pair of charger holders 2c and 2d made of plastic provided at opposite ends of the casing 2a and a discharge wire 2b supported, at its ends, by the charger holders 2c and 2d and extended in the casing 2a. A connector 2e is provided at an end portion of the charger holder 2c so as to be connected to a high-voltage terminal (not shown) for applying high voltage to the discharge wire 2b. The charger holder 2c is formed, at its opposite sides, with a pair of positioning grooves 2f and 2g, while the charger holder 2d is formed, at its opposite sides, with a pair of positioning grooves 2h and 2i. The upper frame portion 6a is formed with a hollow 6c for accommodating the corona charger 2'. Furthermore, in the hollow 6c, positioning lugs 6f, 6g, 6h and 6i are integrally formed with the upper frame portion 6a so as to be brought into engagement with the positioning grooves 2f, 2g and 2i of the corona charger 2', respectively. Meanwhile, the height of each of the positioning lugs 6f to 6i is set so as to be slightly larger than that of each of the positioning grooves 2f to 2i.

Figure 11:
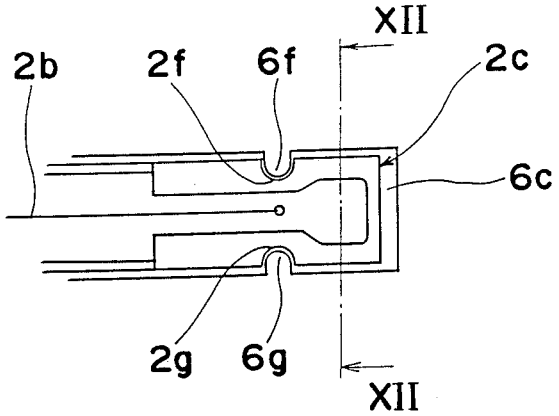
FIG. 11 is a fragmentary top plan view of the corona charger of FIG. 10 mounted on the upper frame portion.
Figure 12A:
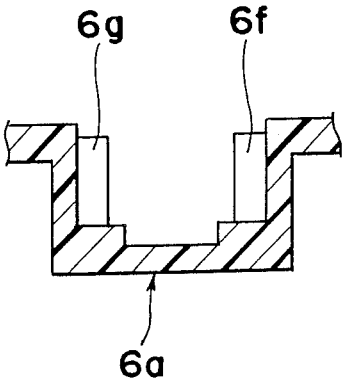
FIGS. 12A to 12C are sectional views taken along the line XII—XII in FIG. 11, showing mounting of the corona charger on the upper frame portion.
Figure 12B:
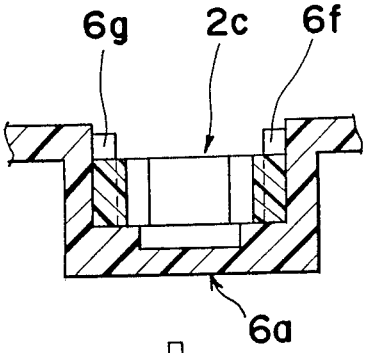
Figure 12C:
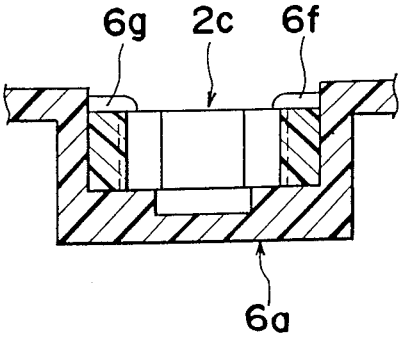

FIG. 11 shows a state in which the corona charger 2' has been accommodated in the hollow 6c. Meanwhile, FIGS. 12A, 12B and 12C show stepwise mounting of the corona charger 2' on the upper frame portion 6a. As shown, by accommodating the corona charger 2' into the hollow 6c of the upper frame portion 6a, the positioning lugs 6f, 6g, 6h and 6i are, respectively, brought into engagement with the positioning grooves 2f and 2g formed at the charger holder 2c and the positioning grooves 2h and 2i formed at the charger holder 2d and thus, the corona charger 2' is positioned. At this time, since height of each of the positioning lugs 6f to 6i is so set as to be larger than that of each of the positioning grooves 2f to 2i, as described above, a head portion of each of the positioning lugs 6f to 6i projects upwardly from each of the positioning grooves 2f to 2i, as shown in FIG. 12B. If the head portion of each of the positioning lugs 6f to 6i, which projects upwardly from each of the positioning grooves 2f to 2i, is fused by ultrasonic wave, etc. in this state, the head portions of the positioning lugs 6f to 6i are fused onto the upper face of the charger holders 2c and 2d, so that the corona charger 2' is prevented from being detached from the upper frame portion 6a upwardly. Namely, the corona charger 2' has been secured to the upper frame portion 6a.

As described above in the cartridge unit K', after the positioning lugs 6f to 6i provided on the upper frame portion 6a have been, respectively, brought into engagement with the positioning grooves 2f to 2i formed on the corona charger 2' such that the corona charger 2' is positioned, the head portions of the positioning lugs 6f to 6i are fused and thus, the corona charger 2' can be secured to the upper frame portion 6a. Namely, the corona charger 2' can be easily mounted on the upper frame portion 6a through common use of the positioning members and the fastening members.

As is seen from the description given so far, with respect to the cartridge unit K', the positioning lugs and the positioning grooves are formed by plastic molding and the corona charger is positioned through engagement of the positioning lugs with the positioning grooves so as to be secured to the cartridge frame by fusion bonding the positioning lugs to the corona charger.

Accordingly, in accordance with the present invention, the corona charger can be easily secured to the cartridge frame without the need for using machine screws, etc., thereby resulting in remarkable improvement of working efficiency and productivity.

Meanwhile, in accordance with the present invention, since the corona charger is secured to the cartridge frame by fusion bonding the plastic positioning lugs to the plastic charger holders of the corona charger without the need for using metallic fastening members, such as machine screws, so that it is needless to take precaution for preventing electrical discharge from the support portions for supporting the discharge wire to the positioning lugs or the positioning grooves. Thus, the positioning lugs or the positioning grooves can be provided adjacent to the support portions for supporting the discharge wire, thereby resulting in a more compact cartridge unit.

Furthermore, in the cartridge frame K', the positioning lugs 6f to 6i of the upper frame portion 6a are fusion bonded to the charger holders 2c and 2d of the corona charger by using ultrasonic wave. However, since the charger holders 2c and 2d of the corona charger are also made of plastic, shape of the positioning grooves 2f to 2i of the charger holders 2c and 2d may be so designed as to be fusion bonded to the positioning lugs 6f to 6i of the upper frame portion *6a* instead of fusion bonding the positioning lugs *6f* to *6i* to the corona charger. Fusion bonding can be performed efficiently by ultrasonic wave but may be performed by other methods such as heating.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A photoreceptor cartridge unit for accommodating a photoreceptor drum and its peripheral components in an image forming apparatus housing, said photoreceptor cartridge unit being detachably mounted on said apparatus housing, said cartridge unit comprising:

a plastic cartridge frame divided into an upper frame portion and a lower frame portion, said upper frame portion being provided with an exposure slit for exposure to a rotatably supported photoreceptor drum, each of said upper and lower frame portions being provided with bearing portions for rotatably supporting said respective photoreceptor drum and peripheral components, each of said bearing portions of at least said lower frame portion being provided with a pair of sidewise opposed integrally formed elastic portions which secure said rotatable supported photoreceptor drum and peripheral components in said cartridge frame, said peripheral components being provided with a plurality of holes and said cartridge frame being provided with a plurality of corresponding projections for positioning said peripheral components on said cartridge frame by fitting said projections into said holes, one end portion of one of said upper and lower frame portions being provided with a protrusion and a corresponding end portion of the other of said upper and lower frame portions being provided with a recess for receiving said protrusion such that said upper and lower frame portions are coupled together, a corona charger as one peripheral component secured to said upper frame portion juxtapositioned to said exposure slit, and a cleaning unit including a scraping blade for removing residual toner from a peripheral surface of said photoreceptor drum secured to said upper frame portion, a container portion formed by said upper and lower frame portions for storing said residual toner and a rotary member supported by one of said bearing portions of said lower frame portion for feeding said residual toner to said container portion.

2. The photoreceptor cartridge unit of claim 1, further including a photoreceptor drum, supported by one of said bearing portions of said lower frame portion.

3. The photoreceptor cartridge unit of claim 1, wherein said corona charger includes a discharge wire and a metallic casing for accommodating said discharge wire said metallic casing terminating at opposite ends as plastic holders each having formed on opposite sides thereof a pair of positioning grooves, said upper frame portion having formed thereon positioning lugs corresponding to said positioning grooves of said respective plastic holders, such that said corona charger is coupled to said cartridge frame via said positioning lugs and grooves.

4. A cartridge frame for accommodating a photoreceptor drum and its peripheral components in an image forming apparatus housing comprising a plastic frame divided into an upper frame portion and a lower frame portion, said upper frame portion being provided with an exposure slit for exposure to a rotatably supported photoreceptor drum, each of said upper and lower frame portions being provided with bearing portions for rotatably supporting said respective photoreceptor drum and peripheral components, each of said bearing portions of at least said lower frame portion being provided with a pair of sidewise opposed integrally formed elastic portions which secure said rotatable supported photoreceptor drum and peripheral components in said cartridge frame, said peripheral components being provided with a plurality of holes and said cartridge frame being provided with a plurality of corresponding projections for positioning said peripheral components on said cartridge frame by fitting said projections into said holes, one end portion of one of said upper and lower frame portions being provided with a protrusion and a corresponding end portion of the other of said upper and lower frame portions being provided with a recess for receiving said protrusion such that said upper and lower frame portions are coupled together, and a cleaning unit including a scraping blade for removing residual toner from a peripheral surface of said photoreceptor drum secured to said upper frame portion, a container portion for storing said residual toner formed by said upper and lower frame portions and a rotary member supported by a first bearing portion of said lower frame portion for feeding said residual toner to said container portion.

5. The cartridge frame of claim 4, further including an opening formed in said upper frame portion for discharge of ozone produced by a corona charger housed therein.

* * * * *